US006383365B1

(12) United States Patent
Boyer et al.

(10) Patent No.: US 6,383,365 B1
(45) Date of Patent: May 7, 2002

(54) LOW SOFTENING POINT PETROLEUM PITCH AND SEALER

(75) Inventors: D. Chris Boyer, Huntington, WV (US); Patricia K. Doolin, Ashland, KY (US)

(73) Assignee: Marathon Ashland Petroleum LLC, Findlay, OH (US)

( * ) Notice: Subject to any disclaimer, the term of this patent is extended or adjusted under 35 U.S.C. 154(b) by 0 days.

(21) Appl. No.: 09/442,154

(22) Filed: Nov. 16, 1999

Related U.S. Application Data

(60) Provisional application No. 60/114,523, filed on Dec. 31, 1998.

(51) Int. Cl.[7] ..... C10G 1/20; C10G 1/18; C10G 3/02; C10G 3/08

(52) U.S. Cl. ..... 208/23; 208/22; 208/44; 208/45

(58) Field of Search ..... 208/45, 22, 23, 208/44; 106/277

(56) References Cited

U.S. PATENT DOCUMENTS 4,006,889 A * 2/1977 Perrott ..... 259/176
4,066,159 A 1/1978 Romovacek
4,222,916 A 9/1980 Hergenrother
4,339,346 A * 7/1982 Schulz et al. ..... 252/31.5
4,537,635 A 8/1985 Bart et al.
5,746,906 A 5/1998 McHenry et al.

* cited by examiner

*Primary Examiner*—Walter D. Griffin
*Assistant Examiner*—Tam M. Nguyen
(74) *Attorney, Agent, or Firm*—Richard D. Stone

(57) ABSTRACT

A 40 petroleum pitch is disclosed. A high melting point petroleum pitch is blended with a high boiling normally liquid petroleum derived hydrocarbon stream to form a mixture having a softening point of 35–45 C. as a partial or complete replacement for coal tar pitch used in driveway sealer and other sealer applications. Driveway sealer (an emulsion of clay, water and binder) made with A 40 has excellent durability and can have a greatly reduced amount of, or be essentially free of, coal tar pitch, greatly reducing the toxicity and odor of the sealer.

6 Claims, No Drawings

LOW SOFTENING POINT PETROLEUM PITCH AND SEALER

CROSS REFERENCE TO RELATED APPLICATIONS

This applications claims the benefit under 35 U.S.C. 120 of prior co-pending, provisional application No. 60/114,523, filed on Dec. 31, 1998.

BACKGROUND OF THE INVENTION

I. Field of the Invention

The invention relates to a low softening point petroleum pitch and sealer made from this pitch for asphalt pavement or metal surfaces.

II. Description of the Prior Art

There are two basic types of driveway or pavement sealer—coal tar based and asphalt based. These materials are primarily used to seal driveways and other pavement surfaces, but can also be used to seal or coat metal, wood, or cementitious surfaces, e.g., pipe coatings.

Coal tar is the premier product and has the largest market share. Driveway sealer made from coal tar is an emulsion of water, coal tar pitch, clay and water, perhaps with emulsifier and optional ingredients such as sand. These materials are long lasting, have a pleasing black color and resistance to gasoline and kerosene spills but have an objectionable odor during application and contain aromatic compounds.

Asphalt based materials are made from distilled petroleum fractions, typically vacuum tower bottoms or perhaps atmospheric tower bottoms. These heavy hydrocarbon fractions are sometimes oxidized or "blown" to change the asphalt properties. Asphalt based sealers do not smell as much as the coal tar based materials and are able to withstand a wider range of temperatures. The asphalt sealers are not as toxic and in some areas only asphalt-based sealers are sold. Asphalt sealers do not have the black color desired by many users. Asphalt sealers do not last as long, and frequently must be reapplied every year or every two years.

The goal of the present invention is to provide a low softening point pitch product similar to coal tar sealer base with similar physical properties such as viscosity and softening point. This material is intended to be a complete, or at least partial, replacement of coal tar, so that sealer base and driveway sealers with acceptable properties can be made with less, or no, coal tar pitch. With that goal in mind, some of the closest art known is reviewed hereafter. The art review can be arbitrarily grouped into four areas:

A. Coal tar driveway sealer

B. Blends of coal tar pitch/petroleum

C. Control of pitch production

D. Low softening point pitches

Coal Tar Driveway Sealer Art

U.S. Pat. No. 4,222,916, Hergenrother, RUBBERIZED COAL TAR PITCH EMULSION, discloses a coal tar based sealer with acrylate emulsion.

U.S. Pat. No. 4,537,635 Bart et al, teaches driveways sealers from oxidized coal tar.

As stated previously, most driveway sealer is either a premium product based on coal tar or a coal tar free, asphalt based product, which lasts for a year. Blends of coal tar and asphalt based products are not sold commercially. An additional concern is that coal tar based driveway sealers comply with the specifications for coal tar based sealers disclosed in ASTM D3320, Emulsified Coal Tar Pitch (Mineral Colloidal Type), and Federal Specification R-P=355e, Pitch, Coal Tar Emulsion (Coating for Bituminous Pavements), which specify use of coal tar pitch. Although coal tar/petroleum pitch blends are not used commercially in driveway sealers, there have been reports of pitch blends for other uses, reviewed next.

Blends of Coal Tar Pitch/Petroleum

Commercial blends of coal tar pitch and a minor amount of petroleum pitch have probably been made. For Aluminum anode binder pitch, reviewed in greater length hereafter, it has been common to "extend" the coal tar pitch by blending in up to 10% petroleum pitch, so that the pitch used was a 90:10 blend of coal tar:petroleum pitch. Some uses of petroleum pitch as an extender for driveway sealer may have occurred but they have not been reported in the literature.

Blends of coal tar with petroleum pitch are known in the art, but not for driveway sealer. This art, reviewed hereafter, is believed to be the closest to the low softening point petroleum pitch of the present invention.

U.S. Pat. No. 5,746,906 McHenry, et. al. May 5, 1998, disclosed a coal tar pitch/petroleum pitch blend and method of making it. A crude coal tar material is selected according to specific properties including QI, specific gravity, water and ash content. A petroleum pitch material is also selected according to its softening point, QI, coking value and sulfur content. The coal tar pitch is distilled to an uncharacteristically high softening point then mixed with a lower softening point petroleum pitch to a desired softening end point. The material retains significant QI and coking value characteristics of pure coal tar pitch particularly for use in Soderberg-type anodes for aluminum smelting as well as electric arc furnace electrodes. PAH emissions, and more specifically B(a)P equivalent emissions, are all reduced by approximately 40%.

The petroleum pitch used in '906 had a softening point of 80° C. nominal. This was mixed with coal tar pitch distilled to have a softening point of 130–175° C.

Control of Pitch Production

Control of coal tar pitch fractionation is described in U.S. Pat. No. 4,066,159.

Control of petroleum pitch fractionation is straightforward distillation.

It is easy to run any pitch fractionation process to produce a product with the desired softening point and this is the norm for most pitches, both coal tar and petroleum.

Low Softening Point Pitch

Some coal tar pitch materials are made with a relatively low softening point. For driveway sealer use, the coal tar pitch will typically have a softening point of around 40° C., as discussed in the driveway sealer art.

Some lower softening point petroleum pitches, which are solids at room temperature have been made by producing a high softening point material, e.g., A240, and blending this with cutter stock such as aromatic oil. It is possible to take A-240 pitch and cut it back with aromatic cutter oil to produce a nominally "solid" pitch specialty product having a low softening point. Some physical properties of various commercial petroleum pitch products are summarized in the following section.

TABLE 1

Specifications and Typical Properties of Marathon Ashland Petroleum Pitch CAS Number 68334-31-6

| Analysis | Test Method | A170 Pitch | A240 Pitch | A225 Pitch |
|---|---|---|---|---|
| Specification Points | | Limits | | |
| Softening Point, Mettler ° C. | ASTM D3104 | 79.4–82.6 | 118–124 | 105–110 |
| Softening Point, Ring & Ball ° F. | ASTM D36 | 166–171 | 235–248 | 212–221 |
| Flash, Cleveland Open Cup, ° C. minimum | ASTM D92 | 200 | 270 | 260 |
| Coking Value, Modified Conradson Carbon, wt %, minimum | ASTM D2416 | NA | 49 | 46 |
| Sulfur Content, wt %, maximum | ASTM D1552 or D4294 | NA | 3.0 | 1.5 |
| Typical Properties | | Values | | |
| Specific Gravity, Helium Pycnometer, g/cc, minimum | ASTM D71 | 1.18 | 1.22 | 1.22 |
| Moisture, wt %, maximum | — | — | 0.5 | – |
| Toluene Insolubles, wt %, minimum | ASTM D4072 | — | 2.10 | 2.10 |
| Quinoline Insolubles, wt % maximum | ASTM D 2318 | 0 | 0.5 | 0.5 |

In addition to these high softening point materials, blends of A240 and #6 fuel oil have been made to produce specialty products ranging from thick liquids to materials having a softening point of 80° C.

"A 500" pitch is a viscous liquid, a blend of 35% A 240 pitch and 65% aromatic oil. The product has a viscosity specification of 230–300 centipoise at 160° F. This material is unsuitable for use as a driveway sealer.

"A 120" pitch is a blend of 37% A 240 pitch and 63% fuel oil. The semi-solid blend has a softening point of about 111° F. It has never been used in a driveway sealer formulation.

ART SUMMARY

This voluminous art could be summarized as follows. Driveway sealers are made from coal tar pitch (premium products) or asphalt, but not both. It is easy to control fractionation of pitch products to produce a pitch product with any desired softening point. Blends of coal tar pitch and petroleum pitch are used for making anodes for aluminum production. Blends of high softening point petroleum pitch with fuel oil or other cutter stock are known, but the blends produced to date have either been too thick or too thin for use as driveway sealer.

There is no commercially available petroleum pitch which can be used directly and without further modification in driveway sealer or for other sealer applications heretofore using coal tar pitch with a softening point of about 40° C.

We discovered a petroleum pitch material could be produced having ideal characteristics for blending with, or replacement of, coal tar pitches previously used for driveway sealers.

It was surprising that a new material, based entirely on petroleum, could be produced which had essentially the same flow characteristics as the coal tar pitch material previously used. We call this material A 40 pitch.

This pitch, when blended with coal tar pitch as part of a driveway sealer base, produced a premium quality product which met all the specifications of pure coal tar based driveway sealers. The material had a somewhat reduced carcinogen level and a somewhat reduced odor, when used in a ratio of petroleum pitch:coal tar pitch of 120:80 or higher, preferably 25:75 or higher, and most preferably 35:65 or higher.

A 40 pitch can also be used as a complete substitute for coal tar pitch, permitting production of a driveway sealer with the durability of a coal tar based product but with essentially none of the odor and toxicity problems associated with coal tar pitch.

Some problems were encountered in selecting the cutter stock and in handling of the A40 pitch, but we discovered ways to overcome these problems and produce an A40 pitch which could be used as a direct replacement for the coal tar pitch when it reached the driveway sealer blending facility.

BRIEF SUMMARY OF THE INVENTION

Accordingly, the present invention provides a 40 petroleum pitch having a Mettler softening point of 35–45 C., comprising a high softening point petroleum pitch having a softening point above 100 C. a petroleum derived cutter oil having less than 10 wt % material boiling below 300 C. and wherein said petroleum pitch form 45–55 wt % of the said A 40 pitch and said petroleum derived cutter oil is the remaining 55 to 45 wt % of said A 40.

A40 pitch can also be made with the following blends:

| | |
|---|---|
| Broadly: | 45–55% A 240<br>55–45% cutter oil |
| Preferred: | 40–60% A 240<br>60–40% cutter oil |

In another embodiment, the present invention provides driveway sealer comprising A40 pitch.

DETAILED DESCRIPTION

For clarity, and to avoid the confusing terminology used in many patents, several terms will be defined. This "definition" section is intended as an overview, with detailed specification for each material provided later.

Driveway sealer means a driveway or paving sealer comprising:

water, clay, emulsifier and

"sealer base" or "binder".

The sealer base or "binder" is the hydrocarbon portion of the driveway sealer. This bonds with or acts as a "binder" for the pavement or driveway. Sealer base of the prior art was either based on coal tar pitch for coal tar based driveway sealers or an asphalt obtained by distillation for prior art asphalt driveway sealers.

Sealer base or "binder" of the invention comprises a blend of:

high softening point petroleum pitch which is a solid at room temperature and a cut-back oil.

In another embodiment, the sealer base comprises a low softening point pitch prepared by direct distillation.

Driveway sealers of the invention, and the sealer base material from which the driveway sealer is made, may be blends of coal tar pitch and petroleum pitch. Pitch is defined below.

Pitch could generically be defined as a heavy thermal tar resulting from thermal polymerization of lighter hydrocarbon materials. Coal tar pitch is the product of thermal or destructive distillation of coal. Petroleum pitch is the thermal polymerization product of thermal processing of relatively light hydrocarbon streams, such as slurry oil or cycle oil from an FCC unit or the like. Wood tar pitch, never used in driveway sealers, has been made for millennia by "cooking" pine oil or the liquid recovered during charcoal manufacture. All these materials, whether derived from coal tar, petroleum or wood, are "pitch" for the purposes of the present invention.

Petroleum pitch is an essential ingredient. For use in areas, which restrict use of coal tar pitch for driveway sealer, petroleum pitch will be the only pitch component present in the sealer base and driveway sealer. In many states, blends of our A40 pitch and coal tar pitch may be used and such blends can be used to create high performance driveway sealers.

Cut-back oil is normally a liquid hydrocarbon stream, which is compatible with both the pitch and the asphalt fraction. There are many normally liquid hydrocarbon streams in a refinery ranging from naphtha fractions to heavy liquids, which are only distillable under a vacuum, e.g., vacuum gas oil. Preferred streams are aromatic extracts, cycle oil and slurry oil from FCC columns, and coker gas oils. Low value heavy fuels, complex blends of heavy liquid refinery products, may be used in some applications though some testing is advised because the quality and characteristics of the heavy fuel oils are so variable.

In our process, the petroleum pitch is produced with a softening point much above that which could be tolerated in the sealer base, and diluted with a controlled amount of cutter solvent or cut-back oil.

Emulsifier means a surfactant, detergent or dispersing agent added to help mix the oil of the sealer base with water to form an emulsion. Use of emulsifiers is well known.

Clay is an essential and well known part of the driveway sealer. The sealer may contain sand, carbon black or other colorants, plastics, thickeners, anti-stripping agents and the like.

Organic anti-strip agents can be used to promote coating and adhesion, increase the resistance of the sealer film to stripping from the clay or sand particles by the action of water. Anti-stripping additives are selected from a group of amines and amines salt. T. J. Gavin and F. A. Hughes: U.S. Pat. No. 3,347,690, Oct. 17, 1967 assigned to Atlas Chemical Industries Inc. Describe the use and chemistry. Sufficient anti-stripping additive is generally used to give good adhesiveness to the mixture. Generally upwards of 0.1% by weight of the sealer is sufficient to fulfill this requirement. A suitable range of additive found to be both efficient and economical for the mixtures of the process is 0.5% to 1.5% by weight of the sealer.

Excellent driveway sealers can be made with "off the shelf" ingredients which are staple articles of commerce and our A 40 pitch.

More details will now be provided about each component.

Each part of the sealer base or "binder" of the invention will now be reviewed in depth, namely the A 40 pitch (A 240 and cut-back oil), and the optional coal tar pitch material and other ingredients added to sealer base or need to make driveway sealers. After this review of the individual components, preferred ratios or blends of various materials will be reviewed, including a brief discussion of some conventional additives for driveway sealer (clay, sand, colorants, and the like) and other sealer applications. This is followed by a review of precautions that need to be taken to get sealer base to the driveway sealer manufacturing facility without phase separation.

Pitch

Petroleum pitch, our A 40 material, is an essential component. Coal tar is a preferred but optional ingredient.

Coal tar pitches, when desired, may be made using the method and apparatus of U.S. Pat. No. 4,066,159, METHOD AND APPARATUS FOR THE CONTROL OF PITCH STILL OPERATION. An oxidized coal tar distillation cut may also be used, as disclosed in U.S. Pat. No. 4,537,635. Coal tar pitch is a beneficial but optional component.

Petroleum pitches may be made using the method disclosed in U.S. Pat. Nos. 4,671,848, 4,243,513, 3,140,248.

Eminently suitable for use herein are the petroleum pitch products available from Marathon Ashland Petroleum A 240 pitch with cutter stock, with the petroleum pitch comprising 45–55 wt % of the blend. The material should be blended to have a softening point of 35–45° C., and preferably has a softening point of 40° C.

The cut back oil is reviewed next. This is essential if starting with A 240 pitch, unnecessary if starting with A 40 pitch prepared with the proper cut-back oil or by straight distillation.

Cut-Back Oil

This is an essential ingredient if the goal is to make sealer base or driveway sealer (and other sealers) starting with A 240 pitch. There are a variety of refinery liquid hydrocarbon streams which can be used, though not necessarily with the same results. These include:

FCC light cycle oil

FCC heavy naphtha

FCC slurry oil, or clarified slurry oil

Gas oil

Vacuum Gas Oil

Coker naphtha

Coker gas oil

Fuel oils (#6, #2, #5, bunker, etc.)

Aromatic extracts

A flash point specification or phase compatibility limit usually sets the minimum boiling point, or front end volatility of such streams.

In general, heavy liquid hydrocarbon streams are better "co-solvents" or cut-back oils than light liquid hydrocarbon streams.

In general, highly aromatic streams are better solvents for the condensed, multi-ringed aromatic structures which make up both the pitch and asphaltic fractions.

Such materials are well known and widely sold, and further discussion thereof is not necessary as one could go to a refinery and purchase these streams.

Critical cutback oil properties are somewhat dictated by the initial softening point of the pitch, but in general for the examples specified are:

Cleveland Open Cup Flash (COC) of 270–400° F.

Viscosity, Fural @ 122° F. of between 20–50 seconds

Cutback oils are preferentially aromatic in nature to provide the best solvency to the system. Aliphatic oils may produce a silvery sheen due to incapability with the highly aromatic pitch. However, use of pure distillate streams as cutter oils instead of slurry oil or fuel oils which are produced from cracking processes would produce additional improvement in environmental impact, in addition to replacing coal tar with either petroleum pitch and/or asphalt if found to be sufficiently compatible.

Coal Tar/Petroleum Pitch Ratios

The process and sealer of the present invention may include some pure coal tar pitch or a mixture of coal tar pitch and petroleum pitch, when the odor or toxicity of the coal tar pitch can be tolerated.

Preferably, the sealer base, and the finished driveway sealer material will be coal tar free, because small amounts of coal tar increase the toxicity of the material and make it impossible to sell in some states. Petroleum pitch is believed to be less toxic than coal tar pitch, and is preferred.

When mixtures of coal tar and petroleum pitch are used, it is beneficial when the petroleum pitch is at least a majority of the pitch component.

When large amounts of coal tar based sealer can be tolerated, the component may be a blend of 10–95 wt %, preferably 25–50 wt % of the total pitch component. A blend of 35–45 wt % petroleum pitch and 65–55 wt % coal tar pitch gives good results.

Binder (Sealer Base) Properties

TABLE 2

| Property | Test | End Point |
|---|---|---|
| Float Test @ 50° C., sec | ASTM D 139 | 170–280 |
| Distillation wt % | ASTM D 20 | |
| 0–170° C. | | 0.0 |
| 0–270° C. | | 1.2 max |
| 0–300° C. | | 3.5 max |
| Softening Point of Residue @ 300° C. R&B, ° C. | ASTM D 36 | 45–55 |
| Flash Point, COC, ° C. | ASTM D 92 | 167 min |

Many of these properties are specified for safety (flash point) or ability to work with these materials in the field (viscosity).

Additives

There are some additional components which are preferred for sealer base and also for generalized sealing, such as coating metal surfaces. These materials are commercially available and per se form no part of the present invention.

The filler can be any suitable filler composition and can be selected from the group consisting of clay, Gibsonite, and tar sands. Filler is present in the asphalt sealing compositions of the present invention in amounts ranging from 30 to 40 wt %, preferably 30 to 35 wt %.

Suitable emulsifying agents can include aqueous polyvinylalcohol, aqueous amines, aqueous compounded amines such as those available from Akzo Chemicals and sold under the trade name Redicote (i.e., Recicote E-9) or those available from B.F. Goodrich Chemical Co. and sold under the trade name Carbopol; and aqueous solutions of aliphatic fatty acids and caustic (usually sodium hydroxide). Exemplary amines are commercially available primary aliphatic amines, trimethylaminediamines such as N-alkyl trimethylenediamine, polyethoxylated aliphatic amines and diamines ($C_8$ to $C_{18}$), amine acetate salts derived from primary, secondary or tertiary amines with the alkyl group ranging from $C_8$ to $C_{18}$, high molecular weight aliphatic primary, secondary or tertiary amines ($C_8$ to $C_{18}$), and quaternary ammonium salts containing one or two alkyl groups ranging from $C_8$ to $C_{18}$. Compounded amines are commercially available and are generally complexed or otherwise stabilized compositions with preserved amine functionality. Ionic aliphatic fatty acids include nonionic polyethoxylated fatty acid compositions available under the trade name Ethofat and other commercially available fatty acid, tall oil and tallow or animal fat ($C_{16}$ to $C_{18}$) based cationic emulsifiers. Emulsifiers are present in the asphalt sealing compositions in amounts ranging from 1 to 10 wt %, preferably from 2 to 5 wt %, say about 1 to 3 wt % based on 100%.

The appearance-enhancing additive can be selected from the group consisting of tallow, carbon black, dyes, and pigments.

Appearance-enhancing additive is present in the asphalt sealing compositions in amounts ranging from 0.5 to 10 wt %, preferably from 1 to 5 wt %, based on 100%.

Sealers for Metal Surfaces/Waterproofing

In addition to use as a driveway sealer, the sealer base may be used as is or modified to permit use for pipe coating or the like. The material may also be used as a waterproofing agent for wood, metal and cementitious materials.

In some instances, coating materials are used in neat form to paint or spray on wood, metal, or cementitious materials. Water or clay may be optional.

EXAMPLES

Example 1

A sealer base is prepared by blending 52.3% petroleum pitch of softening point 115° C. with 47.7% fuel oil with a viscosity of 26 sec, Saybolt Fural @ 50° C. The fuel oil is added slowly to the molten pitch (145–160° C.) and mixed thoroughly, until the blend reaches a characteristic end point of 35° C. softening point as measured by Mettler. The mixture is blended approximately one hour to ensure homogeneity. A laboratory analysis of the final material is summarized in Table 2.

Example 2

A sealer base is prepared by blending a petroleum pitch (115° C. softening point) with a fuel oil with a viscosity of 46 sec, Saybolt Fural @ 50° C., at 48 wt % and 52 wt % ratio. The molten pitch is held at 145° C. while slowly adding the fuel oil with mixing until the mixture reaches a characteristic end point of 36° C. Mettler softening point. Laboratory characterization data are presented in Table 3.

TABLE 3

| Property | Example 1 | Example 2 |
|---|---|---|
| Float Test @ 50° C., sec | 258 | 242 |
| Distillation, wt % | | |
| 0–170° C. | 0 | 0 |
| 0–270° C. | 0.5 | 0.7 |
| 0–300° C. | 2.0 | 2.1 |
| Softening Point of Residue @ 300° C., R&B, ° C. | 48 | 47 |
| Flash Point, COC, ° C. | 204 | 224 |

Example 3

An A-40 sealer is blended with coal tar sealer at a temperature of at least 140° C. and sufficient to ensure good mixing. Laboratory analyses of blends with 15%, 25%, and 50% A-40 sealer (by weight) are presented in Table 4.

TABLE 4

| Property | | | |
|---|---|---|---|
| Wt % A-40 | 15% | 25% | 50% |
| Float Test @ 50° C., sec | 222 | 236 | 246 |
| Distillation, wt % | | | |
| 0–170° C. | 0 | 0 | 0 |
| 0–270° C. | 0.8 | 0.6 | 0.5 |
| 0–300° C. | 2.4 | 2.0 | 1.8 |
| Softening Point of Residue @ 300° C., R&B, ° C. | 48 | 47 | 45 |
| COC Flash, ° C. | 395 | 420 | 430 |

Example 4

A sealer base is prepared by blending 47 wt % petroleum pitch with 53% aromatic extract under similar conditions to Examples 1 and 2 to characteristic end point of 40° C. by Mettler. Properties presented in Table 4.

TABLE 5

| Property | |
|---|---|
| Float Test @ 50° C., sec | 242 sec |
| Distillation, wt % | |
| 0–170° C. | 0 |
| 0–270° C. | 0.5 |
| 0–300° C. | 1.1 |
| Softening Point of Residue @ 300° C., R&B, ° C. | 46 |
| COC Flash, ° C. | 265 |

Example 5

A sealer base is prepared by blending 45 wt % Trolumen 250 petroleum pitch with 55 wt % #6 fuel oil under similar conditions of Examples 1 and 2. Properties of the sealer base are given in Table 6.

TABLE 6

| Property | |
|---|---|
| Mettler Softening Point | 38° C. |
| COC Flash | 199° C. |
| Float @ 50° C. | 218 seconds |
| D–20 Distillation | |
| 0–170° C. | 0 wt % |
| 0–270° C. | 1.0 wt % |
| 0–300° C. | 2.1 wt % |
| Softening Pt. Of Residue, R&B | 44° C. |

Discussion

The A 40 pitch of the invention, a new "sealer base", is compatible with and may be a partial or complete replacement for the coal tar based products currently used to make finished driveway sealer and other sealers. Thus no change is needed in manufacturing or storage procedures.

The use of petroleum pitch permits the valuable and dwindling supply of coal tar pitch to be extended or diverted to other uses. The finished driveway sealer product of the present invention can equal or at least approach very closely a pure coal tar based driveway sealer, and will be far superior to the conventional asphalt driveway sealer materials and will be significantly less toxic than the coal tar materials.

If the driveway sealer blending facility has excellent equipment and keeps the A-40 stirred, then it is possible to use any cheap cutter stock, such as #6 oil, to cut-back the A240 pitch. This material will have a very low aromatic content, but there can be phase separation of the resulting A-40 pitch, A more stable A-40 pitch can be made using an aromatic rich stream, such as an FCC cycle oil, slurry oil, or aromatic extract. This material is much more resistant to phase separation in storage, but will have a higher aromatic content. Even when an aromatic rich cutter oil is used, the A-40 pitch will be significantly less toxic and having less carcinogens than the coal tar based material.

Care should be taken when transporting A-40 to the asphalt-free trucks. The presence of large amounts of asphalt may trigger phase separation.

MODIFICATIONS

Specific compositions, methods, or embodiments discussed are intended to be only illustrative of the invention disclosed by this specification. Variations on these compositions, methods, or embodiments are readily apparent to a person of skill in the art based upon the teachings of this specification and are therefore intended to be included as part of the inventions disclosed herein.

Reference to documents made in the specification is intended to result in such patents or literature being expressly incorporated herein by reference including any patents or other literature references cited within such documents.

We claim:

1. A petroleum pitch having a Mettler softening point of 35–45° C., comprising:

a. a high softening point petroleum pitch having a softening point above 100° C.

b. a petroleum solvent having less than 10 wt % material boiling below 300° C. and wherein c. said petroleum pitch is 45–55 wt % and said petroleum solvent is the remaining 55–45 wt %, based on the total weight of said pitch and said solvent.

2. The pitch of claim 1 wherein said high softening point pitch has a softening point of 240° F.

3. The pitch of claim 1 wherein said solvent is selected from the group of #6 fuel oil, FCC slurry oil and FCC cycle oil.

4. The pitch of claim 1 having the properties of Table 1.

5. The pitch of claim 1 blended with coal tar pitch having a Mettler softening point of 35–45° C., and wherein said petroleum pitch comprises at least 25 wt % of the total amount of petroleum pitch and coal tar pitch.

6. Driveway sealer comprising an emulsion of water, clay and pitch of claim 1.

* * * * *